United States Patent [19]

Voss et al.

[11] 4,081,768

[45] Mar. 28, 1978

[54] SINGLE-STUB TRANSMISSION LINE ELEMENTS IN COMMUNICATION NETWORKS

[76] Inventors: William B. Voss, 387 N. Kenter Ave., Los Angeles, Calif. 90049; Renne S. Julian, 16037 Anoka Dr., Pacific Palisades, Calif. 90272

[21] Appl. No.: 777,394

[22] Filed: Mar. 14, 1977

Related U.S. Application Data

[63] Continuation-in-part of Ser. No. 639,009, Dec. 9, 1975, abandoned.

[51] Int. Cl.[2] ..... H01P 5/12

[52] U.S. Cl. ..... 333/9; 333/97 R

[58] Field of Search ..... 333/6, 8, 9, 97 R

[56] References Cited

U.S. PATENT DOCUMENTS

| | | | |
|---|---|---|---|
| 2,118,471 | 5/1938 | Monk et al. | 333/8 X |
| 3,710,282 | 1/1973 | Seinecke | 333/8 |

*Primary Examiner*—Paul L. Gensler

[57] ABSTRACT

An element in a transmission line network consists of a single, short, open-ended stub which is attached to a transmission line at a single station on that line and which has a characteristic impedance of one-half that of the line. The stub acts on a passing wavefront to: first, reduce the forward voltage for the momentary duration of the two-way transit time within the stub; then, to restore the forward voltage completely and without ringing. With the addition of a high-input-impedance amplifier, an improvement in communication branching is obtained.

4 Claims, 6 Drawing Figures

FIG. 1 PRIOR ART
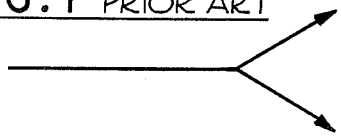
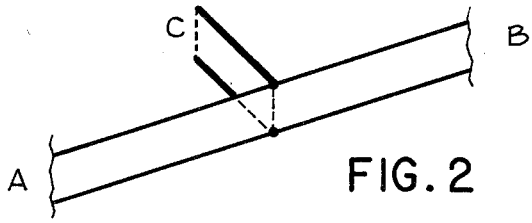
FIG. 2
FIG. 3
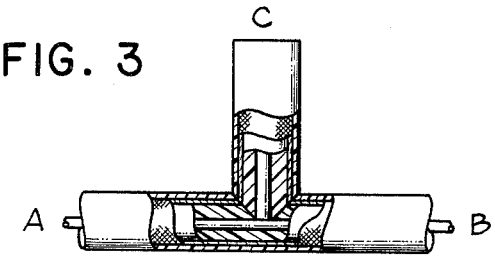
FIG. 4
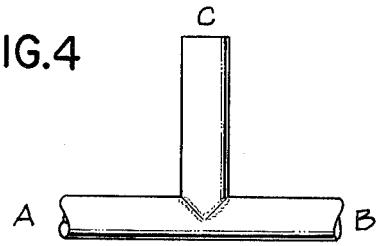
FIG. 6
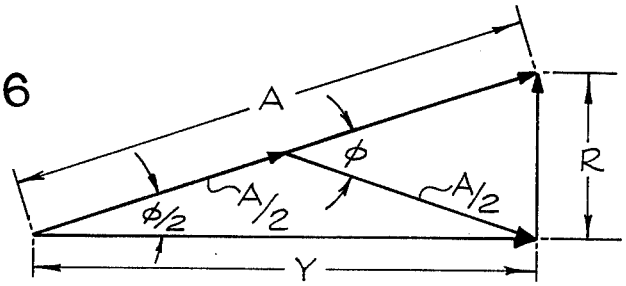
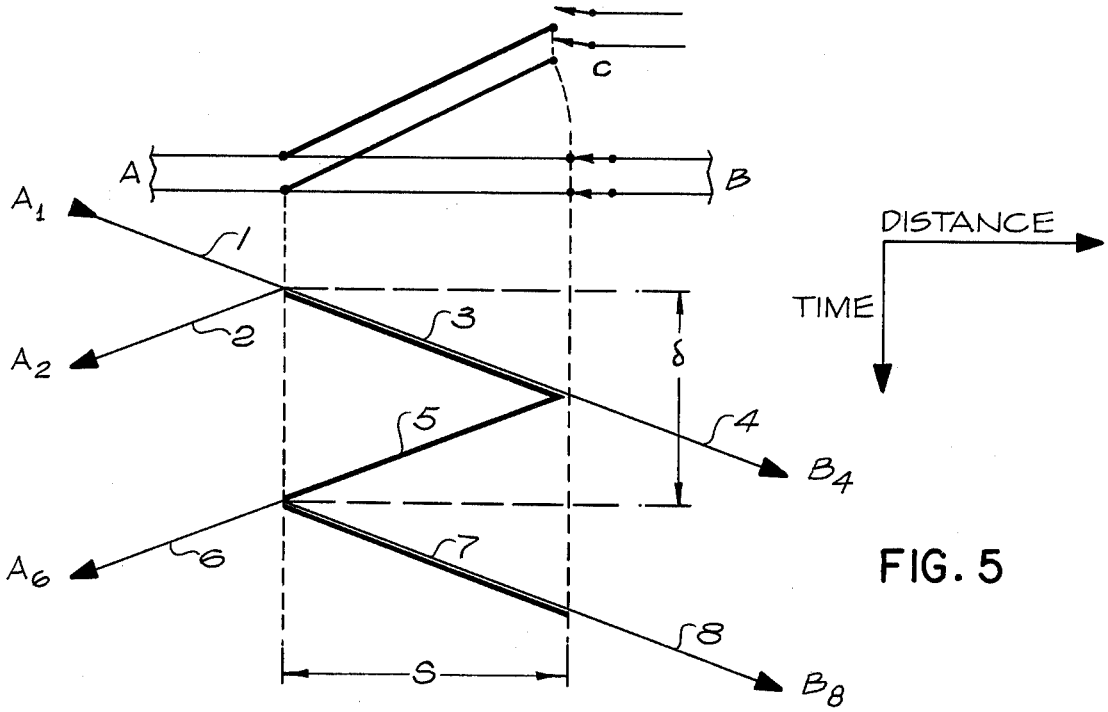
FIG. 5

SINGLE-STUB TRANSMISSION LINE ELEMENTS IN COMMUNICATION NETWORKS

CROSS REFERENCE

This is a continuation-in-part of application Ser. No. 639,009, filed Dec. 9, 1975, now abandoned.

RELATED APPLICATION

Application Ser. No. 777,395, filed Mar. 14, 1977, titled "Double-Stub Transmission Line Elements for Communication and Switching Networks," is a companion application for a similar transmission line element, which has an equivalent voltage restoration capability and provides a similar improvement in communication branching performance. It is referred to occasionally in the body of this specification as the "companion application."

BACKGROUND

In the prior art in communication networks of transmission lines, a problem has always existed when branching of any sort was necessary. Essentially, all branching problems can be reduced to repetitions of the simple two-pronged branch represented by FIG. 1. Here, the stem and one of the prongs represent a main (or trunk) line, and the other prong represents a branch line to a wayside destination. Typical examples are: (1) a digital cable branching a few feet in distance from a computer-driven main cable to one of several peripherals stationed along the main cable, and (2) a main-line television cable with a branch line of several tens of feet in length leading to a customer's house. (Digital distributions systems of the type described in (1) are often called "party-line systems"). Such branching systems are basically troublesome. If the branch lines are terminated with the characteristic impedances of the cables, each such branch robs the trunk line of half of its power (or 29.3 percent of its voltage), and if the branch is terminated with any other impedance—or is left open-ended with an infinite impedance—the resulting transients ("ringing"), caused by repeated reflections, result in severe distortions of the signals carried by the cables.

In U.S. Pat. No. 3,710,282 by Seinecke, dated Jan. 9, 1973, a considerable improvement was made on the above problem in the case of branch line loads that are predominantly capacitative in nature. In Seinecke's invention, a resistor—equal to the "wave resistance" (characteristic impedance) of the branch line minus half of the wave resistance of the main transmission line—was inserted in series with the branch line adjacent to its junction with the main line.

In most of the prior art, the branching network is assmed to be carrying only CW (constant wave) signals consisting of a carrier wave with only small variations in wavelength due to modulation. In general, the lengths and placements of the branches are stated in terms of fractions or integral numbers of wavelengths of the contained signal insofar as they apply to lengths of the branch line or the placement of the branches with respect to the terminus of the main line. The branches may be open or may be terminated with a variety of impedances. The characteristic impedances of the branch lines are generally equal to that of the main line, but may rarely be higher. In effect, the branch lines in the typical case become stubs.

There is additionally a general practice of stubbing which has no intent of providing branch signal lines but only of modifying the behavior of the signal of the main line. From one to three stubs may be involved, often open-ended, and the stub lengths and main-line placements are invariably stated in terms of fractions or integral numbers of the wavelength of the contained signal. In one case, U.S. Pat. No 1,933,669, stubs are added to branches, but they are still stated in terms of the carrier signal wavelength. None of these cases is suitable for pulsed or broad-band signals without incurring excessive losses due to transients and signal distortions.

For pulsed signals there may exist a rare usage of a pair of stubs of nearly, but not exactly, equal lengths for the purpose of performing some act of discrimination on closely-spaced pulses that are generated in the field of nuclear electronics.

In general for pulsed signals, Bewley lattices (which are "bounce diagrams" of time and distance parameters) show that reflections in random-length, single, open-ended stubs are repeated. They die exponentially, sometimes slowly. Each new round trip in the stub is a source of new perturbations on the incoming and outgoing main line. Similar troubles occur if the stubs are closed. Even if the stubs are terminated in characteristic impedances and are either short or long, becoming branch lines, the base junctions of the stubs are sources of unwanted reflections and serious loss of forward power in the main line.

SUMMARY

When a single, short, open-ended stub is added to a transmission line at any selected station on that line and the stub's characteristic impedance is one-half that of the line, a unique effect is obtained in which the portion of a wavefront (in the line) that enters the stub and is reflected from the open end of the stub reacts with that wavefront at the junction at the base of the stub to accomplish several desirable effects at the instant of reaction: (1) it completely cancels the remaining portion of the wavefront that was reflected rearward on the line from the junction, leaving only a short, small pulse as the rearward reflection, (2) it completely restores the forward portion of the wavefront from a momentarily attenuated voltage to the full voltage of the incoming wavefront, and (3) that portion of the wavefront that originally traversed the stub is prevented by the reaction from entering the stub again. This combined cancellation-restoration effect at the instant of reaction prevents any ringing or overshoot occurring on the signal in the line.

Through a multiplicity of these single-stub junctions and the proximate attachment of high-input-impedance amplifiers to the open ends of the stubs in all junctions in a manner that essentially preserves the open-circuit condition of the stubs, a method of branching from transmission lines is obtained which minimizes distortion and transients in the signals and greatly reduces voltage losses on the main line.

BRIEF DESCRIPTION OF THE DRAWINGS

FIG. 1 is a diagrammatic, non-detailed illustration of the prior art in signal branching.

FIG. 2 shows the single-stub element, using twin-lead as the vehicle of the transmission line.

FIG. 3 is an elevational top view of a single-stub element using coaxial cable as the vehicle of transmission line. The junction region is cut away to a cross-sectional view.

FIG. 4 is an elevational top view of a coaxial-cable, single-stub device in tubular metal shields which have been joined together in two semi-circumferential seams, 90° apart.

FIG. 5 shows a single-stub element which has been bent to show its relationship to a variation of the Bewley lattice in order to aid in describing the actions of various wavefronts in the element.

FIG. 6 shows a rotating vector diagram for explaining the action of CW signals in a single-stub element.

DETAILED DESCRIPTION

The Basic Concept

The present invention is the outcome of the discovery of a unique and interesting effect in transmission lines. When a single, open-ended stub of characteristic impedance $\frac{1}{2} Z_c$ is inserted in a transmission line of characteristic impedance $Z_c$, the perturbations, in a traveling wavefront, that are caused by the stub will last only as long as the two-way transit time in the stub. Following the one transit in the stub and the short time delay that results, the effect on the wavefront is as though the stub were not there. The portions of the wavefront energy that enter the stub and return to the junction after being reflected from the end of the stub seemingly are cancelled at that junction. Actually, the stub-traveling portion of the wavefront combines with the main-line portions to produce three desirable results: (1) to completely cancel that portion of the wavefront energy that was reflected backward from the junction on the main line when the wavefront first reached the junction; (2) to completely restore to full voltage and power the forward-going portion of the wavefront, which portion was attenuated during the two-way transit time of the wavefront in the stub; and (3) to prevent, through self-cancellation, any of the stub-traveling portion being reflected back into the stub from the junction. This new arrangement eliminates the "ringing" and overshoot that normally appear in main-line and stub signals when common stubs are used (by prior art). Such ringing and overshoot are caused by the exponentially decaying, repeated reflections that are inherent in common single stubs when pulsed signals are present in the lines. In this discussion, it is assumed that the new single stubs which are the subject of this specification are relatively short in length. The shortness will be defined in the next subsection.

The desirable results mentioned in the previous paragraph cannot be obtained unless the characteristic impedance of the stub is exactly one-half that of the main line to which it is attached. When a wavefront in the main line strikes the stub, one-half of its power enters the stub; one-fourth of its power continues forward; and one-fourth is reflected rearward. After the momentary, two-way traverse of the stub, the unique cancellation-restoration effect cancels all power that is scattered into the stub and reflected rearward, and reorients it forward instead.

Structural Form

In structural form, the invention is extremely simple. Its basic element is merely the connection of a short, open-ended stub to a high-frequency electrical signal transmission line of twice the characteristic impedance of the stub, and the placement is at any desired station on that line. (The comparable case of double stubs without lowered characteristic impedance is submitted in the companion application, Ser. No. 777,395, filed Mar. 14, 1977, cited earlier herein.) The single-stub concept described herein can be likened to a parallel combination of the double stubs of the cited companion application. Note that:

$$(1/Z_c) + (1/Z_c) = (2/Z_c).$$

An open-ended (or open-circuited) stub has essentially infinite impedance between the conductors at its free end. Theoretically, any form of transmission line will suffice for the element if the wavelength of the highest frequency component of its signals is significantly longer than the diameter or width of the line. In practice, forms of transmission line are limited to coaxial cable, twin lead, microstrip, and stripline. Waveguides are excluded because of the shortness of signal wavelengths. The exact length of the stub in the element, aside from being "short," is not critical because the reflection cancellation effect is entirely independent of the wavelength of the contained signals. This is in contrast to the common stub of the prior art, which must be at one-quarter or some other fraction of a referent wavelength in order to be effective. For this invention, the shorter the stub, the less effect it has on the shape of the wavefront in the main line.

For pulsed signals with linearly increasing wavefronts, such as a straight pulse rise, the best results occur when the two-way transit time of the signal in the stub is no greater than the risetime from 0 to 100 percent of pulse voltage. The same relationship applies between linearly decreasing wavefronts (straight pulse falls) and the pulse falltime from 100 to 0 percent of pulse voltage. The equivalent stub length is 50 percent of the pulse rise. With a longer stub, a small step beings to appear at the 50 percent voltage level in the pulse rise, likewise in the pulse fall. For some uses, such as certain types of digital logic, a horizontal step is not harmful, and a stub of up to twice that length can be tolerated.

For best results in CW signals the two-way transit time in the stub should be no greater than the time of the zero-to-peak voltage rise of the highest frequency component of interest in the signals in the line. Such a time corresponds to one-quarter wavelength of a cosine wave. The equivalent one-way length of the stub is one-eighth of the wavelength of the highest frequency component of interest for CW signals. This is the maximum stub length for single elements on a line with CW signals. When the number of stubs on a line increases above one, the allowable stub length must be reduced, as calculations will show later in "Electrical Characteristics, Part 2."

The method of connection between the new stubs and the main line is not critical to the concept of the invention, but a high quality of workmanship in a junction provides a much cleaner waveform than a poorly constructed junction. In FIG. 4 is shown, in top view, and for a coaxial cable element, the preferred form of junction, in which the shields have been soldered or welded together at the V-shaped section consisting of crossed, semi-circumferential seams.

FIGS. 2, 3 and 4 show various views of the single-stub element. FIG. 2 shows the simplicity of the form for two parallel wires ("twin lead"). Although it is difficult to discern in the drawing, the wires of the stub are larger in diameter than in the main line—in accordance with the following standard two-wire formula for characteristic impedance, $Z_c$:

$$Z_c = 120 \cosh^{-1} (D/d)$$

where $D$ is the distance between centers of the two wires and $d$ is the diameter of each wire. The main line in FIG. 2 extends between A and B. The end of the stub is shown as C. The stub need not be at right angles to the main line. FIG. 3 shows the single-stub element in coaxial cable form. The junction area is cut away to a cross-sectional view in order to show the connection of the center conductors. The functions of the letters A, B and C are as in FIG. 2. The center conductor is subject to the same comment regarding enlargement of diameter as above, but in accordance with the following standard coaxial formula for characteristic impedance:

$$Z_c = \frac{60}{\sqrt{\epsilon}} \log_e \frac{D}{d}$$

Where $D$ is the inside diameter of the outer conductor, $d$ is the diameter of the inner conductor, and $\epsilon$ is the dielectric constant (relative permitivity) of the dielectric material between the conductors. In FIG. 4 is shown an elevational, top view of the junction region of the same element, emphasizing the junction of the shields, as cited above. In FIGS. 3 and 4, the external conductor (shield) may be braided, as in most coaxial cables, or may be in the form of metal tubing. In the latter case, the element assumes the form of a separate piece of prefabricated hardware, which is discussed as "the third approach" in the third paragraph following. As shown in FIGS. 3 and 4, the coaxial stub is oriented at 90° to the main line.

In some stringent applications, a radiation-reducing modification may be needed for the open end of the stub. For such use reference is made to either of the two modifications specified in the companion application for double-stub elements (application Ser. No. 777,395, filed Mar. 14, 1977) that was cited earlier herein. Either of the two referent modifications can be adapted to the new single-stub coaxial element by enlarging the diameter of the center conductor proportionately to the required characteristic impedance, $\frac{1}{2} Z_c$.

An amplifier is placed at the end of the stub in order to relay the signal which appears there to some desired receptor (receiving station) off the line. The amplifier must be of high input impedance, preferably more than 1,000 times the characteristic impedance of the line. Two other restrictions on such an amplifier are essential: First, the geometry of its input circuit must not compromise the above restrictions on impedance or stub length; and second, the frequency response of the amplifier must be adequate for the signal. Common microcircuit or hybrid amplifiers with very fine, short input leads are most suitable for this purpose. To minimize the distortion to the stub that such an attachment of an amplifier can cause (because its input leads become an unwanted extension of the conductors of the stub and introduce a finite impedance at the end of the stub), one or two isolation resistors of at least 10,000 ohms resistance each should be inserted between the stub conductors and the input leads to the amplifier.

The stub element must be fabricated separately from the main line because of the inherently larger dimensions of one or both of its conductors (depending on the form of the transmission line used). For twin-lead and microstrip, the forming of the junctions is simple and obvious, but it is less simple for coaxial lines. For coaxial junctions, three approaches are possible. In the first approach, the junction end of the stub is cut to a blunt wedge of approximately 90°. The corresponding mainline is notched to mate the wedge. The shielding is peeled back to permit the center conductors to be soldered or welded, then the shielding is soldered or welded, forming the junction of FIG. 4. In the second approach, the stub is wedged, and the mainline is notched as before. Instead of peeling the stub's shielding, however, the stub's center conductor is made to slip lengthwise within the stub. The center conductor is then pushed forward through the wedge of the stub and is welded or soldered to the mainline conductor at the apex of the notch. Then, the remainder of the stub is slipped forward into the wedge also, permitting its shield to be jointed to the mainline shield. In the third approach, which is most practical, the braided shield is replaced by metal tubing in the junction area and in the stub. The single-stub element then becomes a prefabricated piece of hardware in the form of a T, which is inserted into a mainline by means of RF connectors of low VSWR, placed on both sides of the junction on the mainline. The shape of the seams at the junction remains as above, and as shown in FIG. 4, but fabrication differs. In common with most RF hardware, approach 3 has no plastic cover (although one may be used).

More than one of the stub elements may be placed in series on a line. As long as the quality of the stubbing is good, there is no inherent limit on the number of such elements in series, but practical limits will be imposed where preservation of signal fidelity is important. The spacing between elements is unimportat for pulsed signals, but it is of some importance for CW signals. The latter case is discussed later in the specification.

Since the use of these elements in transmission lines is of value only if some branching of the signal is intended at the elements, the lines with these elements can, and should, be classed as networks. This specification then inherently includes the networks which include these elements as an integral part. Such branching is accomplished using these elements aided by the amplifiers described earlier. The networks for intended use have limitless forms. Some of these are:

1. Multiple-station digital buses ("party-line" buses) which are used between control computers and test equipment in automatic test systems.
2. Community television cable system for distribution to homes.
3. Microstrip systems on printed circuit boards. This list is not intended to be complete.

The electrical characteristics of the single-stub elements are a little more involved than the structure. These characteristics will be presented in two parts, the first treating digital (pulsed) signals, and the second part treatng CW signals. (This follows the order of discovery.)

A requirement for networks using the single-stub concept is that the source impedance of the line driver must match the characteristic impedance of the line, otherwise the reflections generated, however small, will not be absorbed.

Electrical Characteristics, Part 1—Pulsed Signals

Consider FIG. 5, in which a typical single-stub element is shown at the top in a slightly different form. Below it is shown a modified form of the Bewley lattice. The position of the signal on the line (going from left to right) is shown horizontally, and the corresponding time is shown vertically. The signals in the stub, which would logically belong in the third dimension, normal to the paper, are shown adjacent to those in the main line. The reflection points corresponding to the junction and the stub end are obvious. The stub signals are shown in heavier lines than the main signals. (More explanation is given in the next paragraph.) Further, let S be the length of the stub and $\delta$ be the time required for signal travel out and back in the stub. Then $$\delta = 2S/v$$

where $v$ is the signal velocity.

Let a signal of the voltage and current amplitudes of V and I, respectively, enter the stub junction. This is shown in the Bewley lattice as A1 and line 1. There is an immediate reflection of part of the signal back to the origin (A2) of $-\frac{1}{2}$V and $+\frac{1}{2}$I, representing $\frac{1}{4}$ of the signal power and being shown by line 2. The top part of line 3 in the lattice represents $\frac{1}{4}$ of the signal power. It has amplitudes of $\frac{1}{2}$V and $\frac{1}{2}$I and leads uninterruptedly through line 4 to the outlet at B4. The lower, thick part of line 3 in the lattice represents the signal in the stub. It carries half of the signal energy and its amplitudes are $+\frac{1}{2}$V and $+$I. This signal is reflected from the stub end, as shown in line 5 in the lattice. Its amplitudes are $+\frac{1}{2}$V and $-$I. This return signal branches three ways at the junction, as shown by lines 6 and 7 (actually only two ways, as will be seen). The line 6, going to the origin at A6, has amplitudes $+\frac{1}{2}$V and $-\frac{1}{2}$I. The top part of 7 has amplitudes $+\frac{1}{2}$V and $+\frac{1}{2}$I. This signal continues in line 8 to outlet B8. In the bottom part of 7, which contains the reflection back into the stub, the amplitudes are OV and OI, meaning no reflection. Notice that, except for a small time difference $\delta$, the signals in 2 and 6 cancel each other. Likewise the signals in 4 and 8 combine to equal the full incoming signal of V and I except for a time delay of $\delta$. In real systems $\delta$ is measured in picoseconds.

For test results, refer to FIGS. 9, 10 and 11 of the companion application concerning double-stub elements (application Ser. No. 777,395 filed Mar. 14, 1977). In electrical effects on input signals entering at End A and output signals emerging at End B, the two inventions are identical. The only differences are in structural detail and in the fact that only one amplifier can be attached per stub junction in this invention compared to either one or two in the case of double-stub junctions. Thus, the cited FIGS. 9, 10 and 11 are just as applicable to this invention as to the double-stub invention.

The question arises about the effects of placing the herein-defined single stubs at more than one location, say $n$ locations in series, on a transmission line. The total effect is simply additive; i.e., the total increase in line delay, D, due to all of the stubs is equal to the sum of the individual delays, $\delta$, caused by each stub. The effect on the final shapes of the pulse rises and the pulse falls is a little complicated. In steep-sided pulses, the number of steps required to reach full amplitude (or reverse) is $2^n$. In ramp-sided pulses (with slow rise and fall times), the effect is to cause more rounding of the sharp corners (but still less than D in the total effect). Since it is the object of the designer who uses the single-stub concept to keep the individual stubs short, the total delay caused by $n$ locations will be kept small, and is equal to $$D = n\delta = 2nS/v.$$

Even with $n$ locations, however, there is no ringing.

In this specification the term "pulsed signals" is intended to include most digital signals of two or three voltage levels of DC. Exempted signals are those of modulated carriers, such as FSK.

Electrical Characteristics, Part 2—CW Signals

The use of single-stubbing on CW signals in the form of pure sine waves has both favorable and unfavorable effects. For the forward-going portion of the wave—beyond the stub intersection—the effect is favorable. There is no distortion; the amplitude reduction is slight; the phase delay is small and is generally harmless. For the reflected portion of the wave the effect could be serious if more than one single-stub junction should be placed on the line (or if the signal generator were unmatched). The seriousness is due partly to the fact that the CW reflected wave is continuous rather than being of short, transient duration, as is the nature of reflected pulses. Even though the CW reflected wave's amplitude is small, it cannot be neglected completely if it is ever rereflected forward at a second junction. That is due to the amplitude-sensitive nature of CW (analog) signals in general.

In contrast, pulsed (digital) signals are quite insensitive to amplitude variations, requiring only that the signals be above or below their triggering voltage level. The rereflected pulsed wave is always 25 percent or less of the normal wave and thus is below the voltage level of triggering. (Severe noise could cause some problems, however.)

For the reason of rereflection cited above, the maximum stub length allowable for use with CW signals, when a second junction is added on a line, is about 5 percent of the signal wavelength. For the general case of three or more single-stub junctions on a line, the stub lengths should be considerably less, partly to render rereflected waves harmless and partly because of amplitude degradation in the forward-going waves. The latter condition is due to phase delay effects, which will be shown in the discussions on $Y_n$ and $S_n$ in subsequent paragraphs.

When modulation is added to sine waves, the effect is more complicated, and it is treated briefly later.

Consider again one single-stub element, as in FIG. 2. Assume that the stub length, S, is small compared to the wavelength, $\lambda$, of the signal (say, less than 5 percent of $\lambda$). Then if one ignores the skin effect and the cable losses inherent in transmission lines, the attenuation caused by the stub pairs is small, and there is no distortion. The reflected signal is fairly small. If we call the input voltage amplitude A, the output consists of two components of equal amplitudes, A/2. A time delay, $\delta$, equivalent to a phase delay, $\phi$, separates the two output components. This is shown graphically by a rotating vector diagram in FIG. 6. Y is the resultant output signal amplitude (being the vector sum of the initial and delayed components, A/2 each. The net phase delay between input A and output Y is $\phi/2$ radians. The reflected component is shown by R, where $$R = A \sin \phi/2.$$

Some further statements are:

$$\delta = 2\,S/v \text{ (as before)}$$

$$\phi = \omega\delta = 2\pi f\delta = 2\pi v\delta/\lambda \text{ radians}$$

$$\phi = 4\pi S/\lambda \text{ radians,}$$

where $\omega$ and $f$ are angular velocity and frequency, respectively. If we let $S/\lambda = 0.05$, which is the 5 percent assumed above, $$R = 0.31A.$$

Call $R_2$ the rereflected amplitude from a second single-stub junction. Then $$R_2 = (0.31)^2 A = 0.096A.$$

In order to reduce $R_2$ to 1 percent of A, $S/\lambda$ should be no greater than 0.016.

The expression for output amplitude of the forward-going wave of a CW signal is given by $$Y_1 = \frac{A}{2} e^{-j\omega t} + \frac{A}{2} e^{-j\omega(t-\delta)}$$

$$Y_1 = \frac{A}{2} e^{-j\omega t}(1 + e^{j\omega\delta})$$

The subscript 1 is introduced to represent one stub on a line.

For the case of two stubs in sequence along a transmission line:

$$Y_2 = \frac{A}{4} e^{-j\omega t}(1 + 2e^{j\omega\delta} + e^{j\omega 2\delta})$$

$$Y_2 = \frac{A}{4} e^{-j\omega t}(1 + e^{j\omega\delta})^2$$

For $n$ stubs in sequence we have $$Y_n = \frac{A}{2^{n^e}} {}^{-j\omega t}(1 + e^{j\omega\delta})^n$$

which may be written $$Y_n = Ae^{-j\omega t}\left(\frac{1 + e^{j\phi}}{2}\right)^n$$

The parenthetical portion defines the number and respective amplitudes of the various output components very simply by means of the binomial theorem.

It is essential to know what maximum stub length, $S_n$, can be tolerated when $n$ stubs are in sequence, assuming a certain allowable degree of attenuation of the final signal. The calculation becomes fairly easy if we assume an allowable attenuation of 50 percent of input power, corresponding to an output/input voltage ratio of $1/\sqrt{2}$. (Transmission line losses are neglected.) For this, $\phi$ is determined by $$\cos\frac{\phi}{2} = \sqrt[2n]{0.5}$$

from which $S_n$ is given by $$S_n = \lambda\phi/4\pi$$

Thus, if one assumes a television cable feeding $n$ customers in sequence, with a stub for each customer, then the allowable stub lengths are $$S_{10} = 0.042 \text{ (where } n = 10)$$

$$S_{99} = 0.013 \text{ (where } n = 99)$$

When the effect of line loss is considered, the allowable stub lengths become larger but the calculations involved become extremely tedious. When the input waveform is modulated (by amplitude, frequency, or phase) a small amount of distortion is introduced into the resultant output waveform by the stub sets along the line. As long as the stub lengths are small, this distortion is negligible for communication purposes.

If the reflected wave magnitudes are small, the spacing between stub junctions on a line is immaterial. If the reflected waves cannot be neglected due to inability to keep the stub lengths small enough, their ghosting effect can be minimized by separating adjacent stub junctions by an approximate distance $(K+\frac{1}{2})\lambda$ on the line, where K is any integer and $\lambda$ is the principal or average wavelength of interest, such as the carrier wavelength. This promotes a self-cancellation of reflected waves between pairs. The distance $(K+\frac{1}{2})\lambda$ is not a general limitation on the placement of multiple single-stub junctions on the line. It provides no advantage either when S, the stub length, is small enough to render the reflected waves insignificant or when the signals are pulsed instead of CW.

Advantages

The primary advantage of the invention is that, wherever branching from a transmission line is desired, the single-stub concept described herein enables a signal to be transmitted past the branching point with a minimum of energy being reflected backward at the junction and a minimum of distortion and energy loss in the forward direction on the line. The signal in the stub is cancelled after the first round trip in the stub. The reflected signal (on the incoming line) is negated after just one propagation time of the round trip in the stub. Likewise, the forward signal is brought up to the original level at the same time. The transient perturbation in pulsed signals (or the net phase delay in CW signals) is kept insignificant by keeping the stub short, which keeps the duration of the perturbation short. The stub length should be significantly less than the wavelength of the highest frequency component of interest, depending on the quality of the signal response desired, except that for CW signals with one carrier frequency and a narrow spectrum the stub length may be one-half of the signal or carrier wavelength.

Although the present invention has been shown and described with reference to particular embodiments, various changes and modifications obvious to one skilled in the art to which the invention pertains are deemed to be within the spirit, scope, and contemplation of the invention.

What is claimed is:

1. A high frequency electrical signal transmission-line network comprising multiple single-stub elements connected on a main transmission line, each said element containing one short stub which is open at its distant end, the characteristic impedance of said stub being one-half of that of the said main line, said stub being attached structurally and electrically to the said main line in such a manner that at the resulting stub junction the said stub presents half the impedance of, and the outgoing portion of the said main line presents an equal impedance to, the incoming portion of the said main line;

the spacing between said single-stub elements being unrestricted for lines carrying pulsed signals, being unrestricted also for lines which carry CW signals and in which the said stubs are sufficiently short to avoid rereflection of signal waves, but, on the other hand, said spacing being restricted to a distance of $(K+\frac{1}{2})\lambda$ for all remaining lines carrying CW signals, $\lambda$ being the carrier signal wavelength and K being any integer;

said single-stub elements substantially eliminating ringing and overshoot and substantially reducing remaining distortion and forward-going power losses in pulsed wavefronts traveling in stubbed transmission lines.

2. A transmission line network as described in claim 1 wherein said main line and said stub are both of coaxial cable, the outer conductors of the cable in both parts being of identical diameters, the inner conductor of the cable in the stub being sufficiently larger in diameter than the inner conductor of the main line to reduce the characteristic impedance of the stub by half;

the direction of said stub being at 90° to the said main line;

the said inner conductors being soldered together at the point of junction and the said external conductors being soldered together such that the resulting junction forms two half-ellipses oriented in planes at 90° to each other and at 45° to the directions of both said stub and said main line.

3. An extension of the network in claim 1 wherein is provided a branching capability from the signal in the said main line of the said network to multiple branch receiving stations, the said branching capability being provided by structurally and electrically attaching a small amplifier to the open end of the stub of each single-stub element of claim 1;

the input resistance of which amplifier is high, exceeding the characteristic impedance of the said main line by at least 1,000 times, and the input geometry of which amplifier does not compromise the impedance or length of its stub, such that the internal reflection of the said pulsed wavefront within the connected said stub is complete and undisturbed by the presence of the amplifier, which said amplifier is able to sense and relay the pulsed wavefront within the stub to the said branch receiving station in undistorted form.

4. A coaxial, single-stub device which may be inserted in a main-line coaxial cable for the purpose of branching therefrom, said insertion being in multiple, selected locations along the main line, and one said device to an insertion;

the spacing between said single-stub devices being unrestricted for lines carrying pulsed signals, being unrestricted also for lines which carry CW signals and in which the said stubs are sufficiently short to avoid rereflection of signal waves, but, on the other hand, said spacing being restricted to a distance of $(K+\frac{1}{2})\lambda$ for all remaining lines carrying CW signals, $\lambda$ being the carrier signal wavelength and K being any integer;

connection of the device to the main-line cable being by standard RF connectors of low VWSR;

said device being a hardware element in the form of a "T," the "top" of which T is the trunkline, and is terminated at each end with one of said connectors, and the "stem" of which T is open at its distant end, forming a single, short, open-ended stub;

the exterior surface of said device being a tubular metal shield, forming the outer coaxial conductor of both the said trunkline and stub and being of a common diameter throughout, the junction between the trunkline and the stub consisting of two semi-elliptical seams oriented in planes 90° apart and 45° from both the trunkline and the stub axes;

the inner conductor of which device forms a simple, one-junction T located coaxially within said outer conductor, the space between both conductors containing sufficient dielectric material for structural support;

the characteristic impedance of said device being of two parts, that of the first part matching that of the connected said main-line cable and applying to the said trunkline (top of the T) and the said connectors of the device, and that of the second part being one-half of that of the first part and applying only to the said stub (stem of the T) and being obtained by enlarging the diameter of the stub center conductor in accordance with the standard coaxial-line formula for characteristic impedance in the following manner:

the characteristic impedance of the line and the stub being, respectively $$Z_l = \frac{60}{\sqrt{\epsilon}} \log_e \frac{D}{d_l}$$

$$Z_s = \frac{60}{\sqrt{\epsilon}} \log_e \frac{D}{d_s} = \frac{Z_l}{2}$$

subtracting the second from the first $$Z_l - Z_s = \frac{60}{\sqrt{\epsilon}} \log_e \frac{D}{d_l} \times \frac{d_s}{D} = \frac{Z_l}{2}$$

$$d_s = d_l \exp\left(\frac{Z_l\sqrt{\epsilon}}{120}\right)$$

$d_l$ and $d_s$ representing the diameters of the center conductors of the line and the stub, respectively;

the stub end of which device can allow a small amplifier to be structurally and electrically attached such that the internal reflection of pulsed wavefront within the stub is complete and undisturbed by the presence of the amplifier, said amplifier having an input impedance exceeding the characteristic impedance of the trunkline by at least 1,000 times and being able to sense and relay the signal within the device to a branch receiving station in undistorted form.

* * * * *

UNITED STATES PATENT AND TRADEMARK OFFICE

CERTIFICATE OF CORRECTION

PATENT NO. : 4,081,768

DATED : March 28, 1978

INVENTOR(S) : William B. Voss and Renne S. Julian

It is certified that error appears in the above-identified patent and that said Letters Patent are hereby corrected as shown below:

Column 9, line 22, correct the formula to read:

"$Y_1 = \frac{A}{2} e^{-j\omega t}(1+e^{j\omega\delta})$";

Column 9, line 37, correct the formula to read:

"$Y_n = \frac{A}{2^n} e^{-j\omega t}(1+e^{j\omega\delta})^n$";

Signed and Sealed this

*Third* Day of *October 1978*

[SEAL]

*Attest:*

RUTH C. MASON
*Attesting Officer*

DONALD W. BANNER
*Commissioner of Patents and Trademarks*